US009234513B2

(12) United States Patent
Cheng et al.

(10) Patent No.: US 9,234,513 B2
(45) Date of Patent: Jan. 12, 2016

(54) FOOT OPERATED SNIVEL SUCTION DEVICE

(71) Applicants: I-Jung Cheng, Tainan (TW); Chien-Chang Cheng, Tainan (TW)

(72) Inventors: I-Jung Cheng, Tainan (TW); Chien-Chang Cheng, Tainan (TW)

( * ) Notice: Subject to any disclaimer, the term of this patent is extended or adjusted under 35 U.S.C. 154(b) by 260 days.

(21) Appl. No.: 14/038,779

(22) Filed: Sep. 27, 2013

(65) Prior Publication Data

US 2015/0093268 A1 Apr. 2, 2015

(51) Int. Cl.

| | |
|---|---|
| ***F04B 23/04*** | (2006.01) |
| ***F04B 41/06*** | (2006.01) |
| ***F04B 33/00*** | (2006.01) |
| ***F04B 9/14*** | (2006.01) |

(52) U.S. Cl.
CPC .. *F04B 33/00* (2013.01); *F04B 9/14* (2013.01)

(58) Field of Classification Search
CPC ..... F04B 33/00; F04B 9/14
See application file for complete search history.

(56) References Cited

U.S. PATENT DOCUMENTS

| | | | | | |
|---|---|---|---|---|---|
| 527,248 | A | * | 10/1894 | North | 92/48 |
| 4,334,839 | A | * | 6/1982 | Flagg | 417/536 |
| 5,358,385 | A | * | 10/1994 | Wang | 417/44.8 |

FOREIGN PATENT DOCUMENTS

| | | | |
|---|---|---|---|
| TW | M425181 | * | 3/2012 |

* cited by examiner

*Primary Examiner* — Kristen Matter

(57) ABSTRACT

A snivel suction device includes a base plate, two pump cylinders, two pistons, two connection rods, a pedal and two casings. Each pump cylinder is provided with a manifold containing a suction check valve and a release check valve. Two suction pipes are connected between a suction tee and the suction check valves of the manifolds. Two release pipes are connected between a release tee and the release check valves of the manifolds. A relief valve is installed at one of the casings. The relief valve has a knob, an adjustment member, a bolt, a valve body, a spring, a plug and a sound member. By operating the two ends of the pedal alternately, the two pistons are operated to suck and release air. Particularly, the relief valve can be actuated when a higher vacuum pressure has occurred in the suction pipes so as to protect the user's nasal mucosa.

6 Claims, 10 Drawing Sheets

FOOT OPERATED SNIVEL SUCTION DEVICE

FIELD OF THE INVENTION

The present invention relates to a snivel suction device, and more particularly, to a snivel suction device operated by a foot and having a pressure relief valve to protect the user.

BACKGROUND OF THE INVENTION

The conventional snivel suction device for sucking snivel or sputum is disclosed in Taiwan Publish No. M425181 and the suction device is also used as a pump to inflate objects. The conventional snivel suction device generally comprises a body with a support frame at a central top thereof. The support frame has a pivotal portion. A pedal is pivotably connected to the pivotal portion of the support frame at a middle portion thereof by a pivot. Two pumps are located in the body and each pump has a piston which is pivotably connected to two opposite ends of the pedal by two push members. Two check valves are connected to the underside of each pump. A suction pipe and a release pipe are respectively connected to the two check valves of each pump. A suction tee is connected between the two suction pipes, and a release tee is connected between the two release pipes. A suction outer tube is connected to the suction tee. A release outer pipe is connected to the release tee. The user may operate the two opposite ends of the pedal which is pivoted about the pivotal portion of the support frame, and the two pistons are alternately operated and cooperated with the check valves so as to suck and release air.

However, when the suction device is used to suck snivel, the suction outer tube that is connected to the suction tee may be attached to the nasal mucosa because of unintentional operation; if the user does not notice this situation, the suction action will cause a higher vacuum pressure in the suction pipe. The higher vacuum pressure can easily damage the nasal mucosa.

The present invention intends to provide a snivel suction device that can solve the shortcomings mentioned above.

SUMMARY OF THE INVENTION

The present invention relates to a snivel suction device and comprises a base plate, two pump cylinders, two pistons, two connection rods, a suction tee, a release tee, two suction pipes, two release pipes, two casings, a pedal, and a relief valve. The two pump cylinders are mounted on the base plate. Each pump cylinder has a protrusion at an inner surface of its bottom. Each pump cylinder is provided at its surrounding wall with a manifold and defines a through hole which allows the manifold to communicate with an inner space of the corresponding pump cylinder. Each manifold has a suction check valve and a release check valve. The suction tee and the release tee are provided at the base plate. The two suction pipes are respectively connected between the suction tee and the suction check valves of the manifolds of the pump cylinders. The two release pipes are respectively connected between the release tee and the release check valves of the manifolds of the pump cylinders.

The two casings are connected to the base plate and cover the two pump cylinders. Each casing has a notch and a lug with a pivotal hole. One of the two casings defines a suction hole corresponding to one opening of the suction tee whilst the other one of the two casings defines a release hole corresponding to one opening of the release tee. The pedal is pivotally connected to the pivotal holes of the lugs of the two casings by two pivots.

The two pistons, which are respectively located in the two pump cylinders, are connected to two opposite parts of the pedal by the two connection rods, which respectively pass through two holes formed by the notches of the two casings.

A relief valve, which is installed at one of the two casings, includes a knob, an adjustment member, a bolt, a valve body, a spring, a plug, and a sound member. The knob has multiple positioning members and multiple bars. The adjustment member, which is located in the knob, has an outer tube and multiple guiding protrusions provided at a bottom of the outer tube. The multiple bars of the knob are inserted through the guiding protrusions of the adjustment member. The adjustment member has an inner tube extending from the bottom of the outer tube thereof such that an annular recess is defined between the outer tube and the inner tube thereof. The outer tube of the adjustment member defines at least one guide slot at its outer surface, wherein the guide slot has multiple positioning recesses. The inner tube of the adjustment member is provided with inner threads at its inner surface, near its bottom, for threaded engagement with the bolt. The inner tube of the adjustment member is provided at its outer surface with a seal ring. The valve body has a main tube, one end of which is provided with a positioning part and is capable of being inserted into the annular recess of the adjustment member whilst another end of which is formed into a reduced tubular portion. The positioning part is located in the guide slot of the adjustment member. The valve body has two connection tubes, which communicate with the main tube and through which the valve body is connected to one of the two suction pipes. The plug is fitted in the main tube of the valve body and urged by the spring located between the bolt and the plug. The sound member defines therein an inner space and has a mounting tube for allowing the sound member to be mounted over the reduced tubular portion of the main tube of the valve body, wherein the sound member defines an outlet hole within the mounting tube, communicating with the inner space thereof, and defines an inlet hole opposite to the outlet hole, communicating with the inner space thereof.

Preferably, a pad is attached to the underside of the base plate.

Preferably, the two opposite parts of the pedal are symmetrical about a pivotal axis aligned with the two pivots and, each of the two opposite parts of the pedal extends at an angle to a horizontal line.

Preferably, the bolt of the release valve has a protrusion at its front end for fitting with a rear end of the spring and defines a slot at its rear end.

Preferably, the valve body of the relief valve has multiple fixing lugs and each fixing lug has a hole. The fixing lugs allow the valve body to be fixed to one of the casings.

Preferably, the plug of the relief valve forms a curved face at its front end, towards the reduced tubular portion of the main tube of the valve body, and has a protrusion at its rear end for fitting with a front end of the spring.

The primary object of the present invention is to provide a snivel suction device which does not need electric power and can continuously suck and release air. Through the relief valve and the sound member, a user can be informed of a problem in operating the snivel suction device and can be protected from an injury of nasal mucosa.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
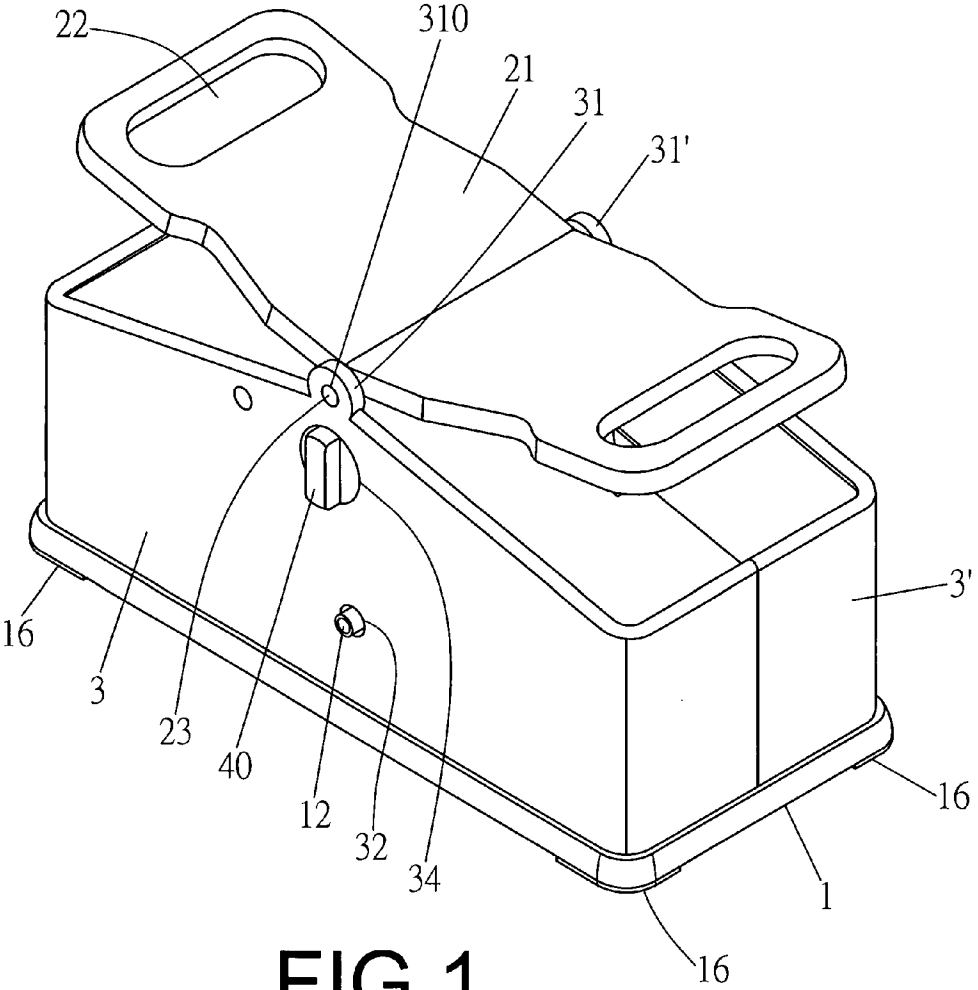
FIG. 1 is a perspective view of a snivel suction device according to one embodiment of the present invention.
Figure 2:
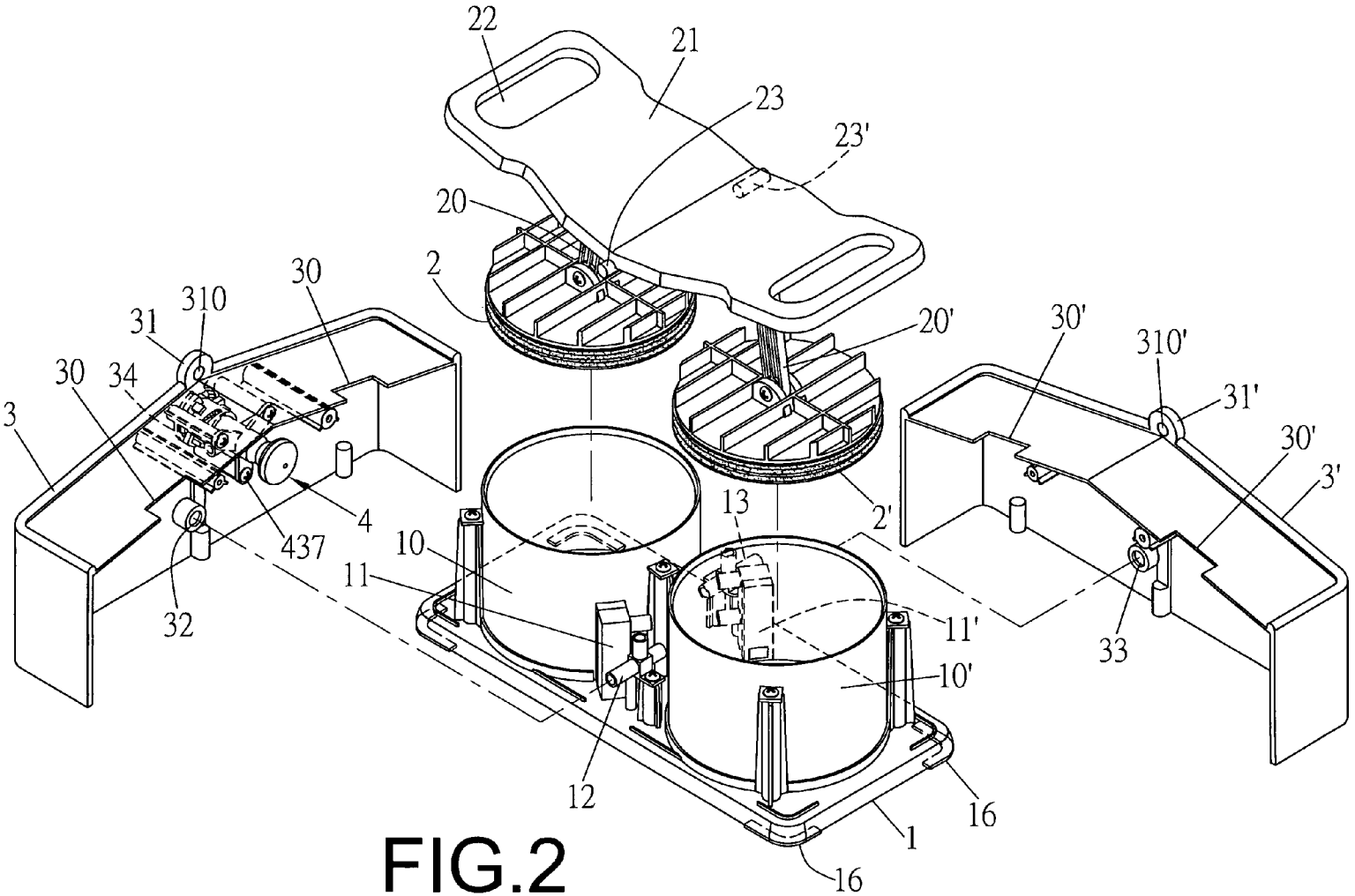
FIG. 2 is an exploded view of the snivel suction device of the present invention.
Figure 3:
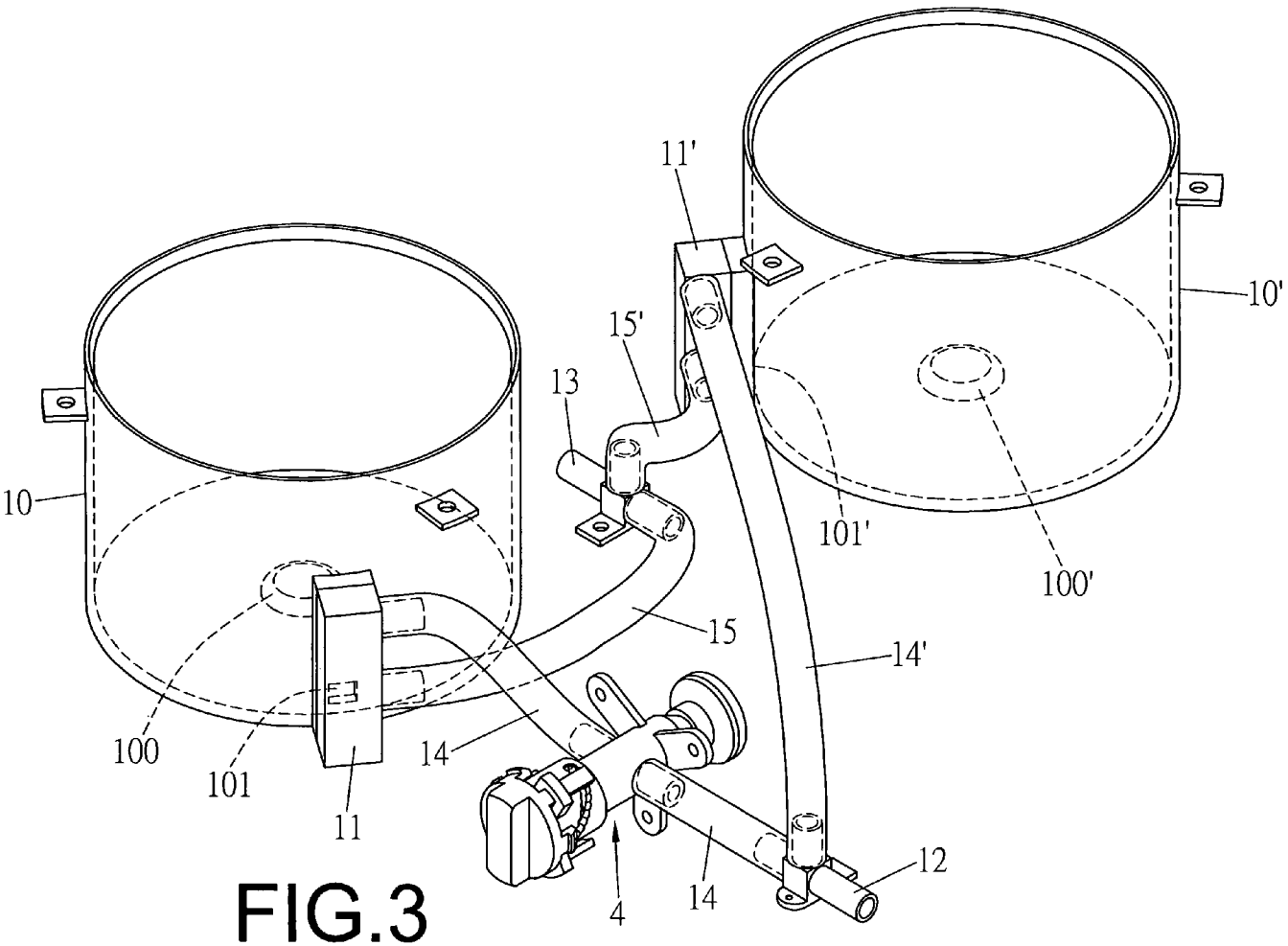
FIG. 3 is a perspective view of a combination of the pump cylinders, the relief valve, the suction pipes, the suction tee, the release pipes, and the release tee of the snivel suction device of the present invention.

Referring to FIGS. 1 to 9, the snivel suction device of the present invention generally comprises a base plate 1 and two pump cylinders 10, 10' mounted on the base plate 1, wherein the pump cylinders 10, 10' respectively have protrusions 100, 100' at the inner surfaces of their bottoms. The pump cylinders 10, 10' are respectively provided at their surrounding walls with manifolds 11, 11' and defines through holes 101, 101' which respectively allow the manifolds 11, 11' to communicate with the inner spaces of the pump cylinders 10, 10' (see FIG. 9). The manifold 11 is provided with a suction check valve 110 and a release check valve 111. The manifold 11' is provided with a suction check valve 110' and a release check valve 111'. A suction tee 12 and a release tee 13 are respectively provided on the base plate 1. A first suction pipe 14 is connected between the suction tee 12 and the suction check valve 110 of the manifold 11 of the pump cylinder 10. A second suction pipe 14' is connected between the suction tee 12 and the suction check valve 110' of the manifold 11' of the pump cylinder 10'. A first release pipe 15 is connected between the release tee 13 and the release check valve 111 of the manifold 11 of the pump cylinder 10. A second release pipe 15' is connected between the release tee 13 and the release check valve 111' of the manifold 11' of the pump cylinder 10'. Four anti-slip pads 16 are respectively attached to four corners of the underside of the base plate 1.

Two casings 3, 3' are connected to the base plate 1 so as to cover the two pump cylinders 10, 10. The two casings 3, 3' respectively have their notches 30, 30' and lugs 31, 31 with pivotal holes 310, 310'. The casings 3 has a suction hole 32 which is located corresponding to one opening of the suction tee 12, and the other casing 3' has a release hole 33 which is located corresponding to one opening of the release tee 13. A though hole 34 is defined at the casing 3, above the suction hole 32.

Two pistons 2, 2' are respectively located in the pump cylinders 10, 10'. A pedal 21 is pivotally connected to the pivotal holes 310, 310' of the lugs 31, 31' of the two casings 3, 3' by two pivots 23, 23'. The pedal 21 is composed of two opposite parts including a first part and a second part, symmetrical about a pivotal axis which is aligned with the two pivots 23, 23', wherein each of the two opposite parts extends at an angle to a horizontal line, and defines a grasp hole 22 at its end.

A first connection rod 20 is connected between the first part of the pedal 21 and the piston 2. A second connection rod 20' is connected between the second part of the pedal 21 and the piston 2', wherein the two connection rods 20, 20' respectively pass through two holes formed by the notches 30, 30' of the casings 3, 3', so that the two pistons 2, 2' can be driven by the pedal 21 to conduct forth-and-back motion in the pump cylinder 10, 10'.

Figure 4:
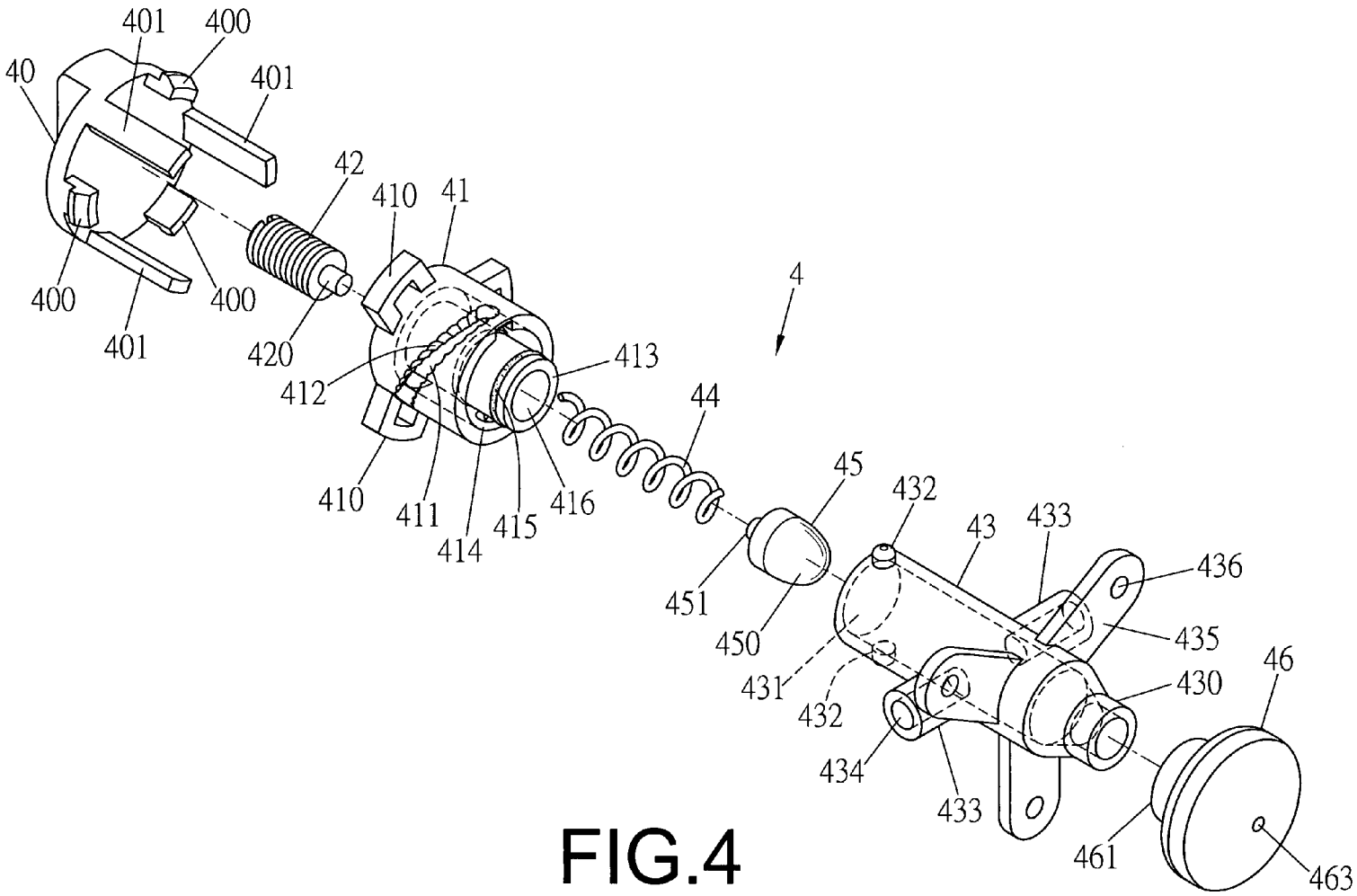
FIG. 4 is an exploded view of the relief valve of the snivel suction device of the present invention.
Figure 5:
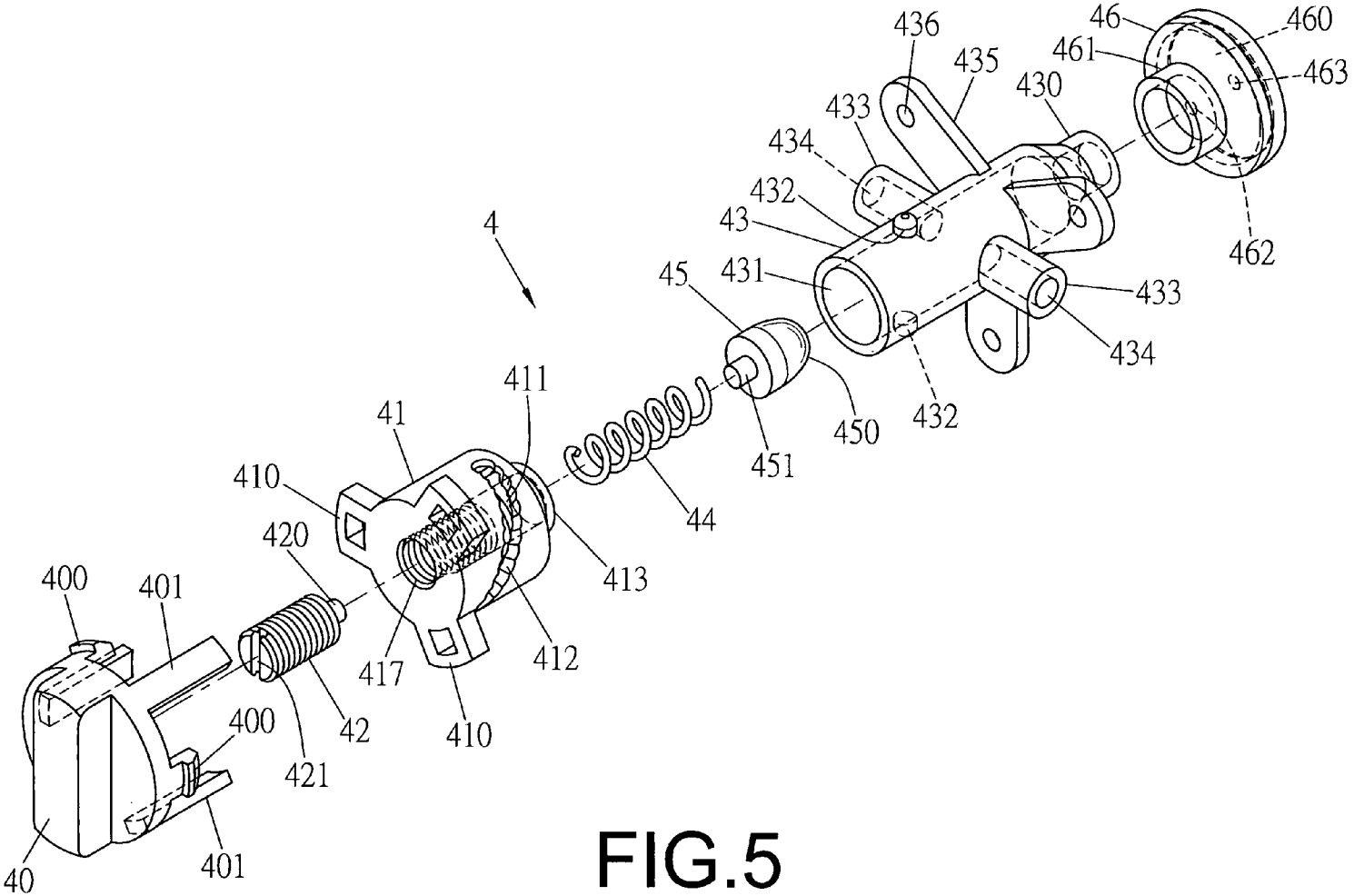
FIG. 5 is another exploded view of the relief valve of the snivel suction device of the present invention.
Figure 6:
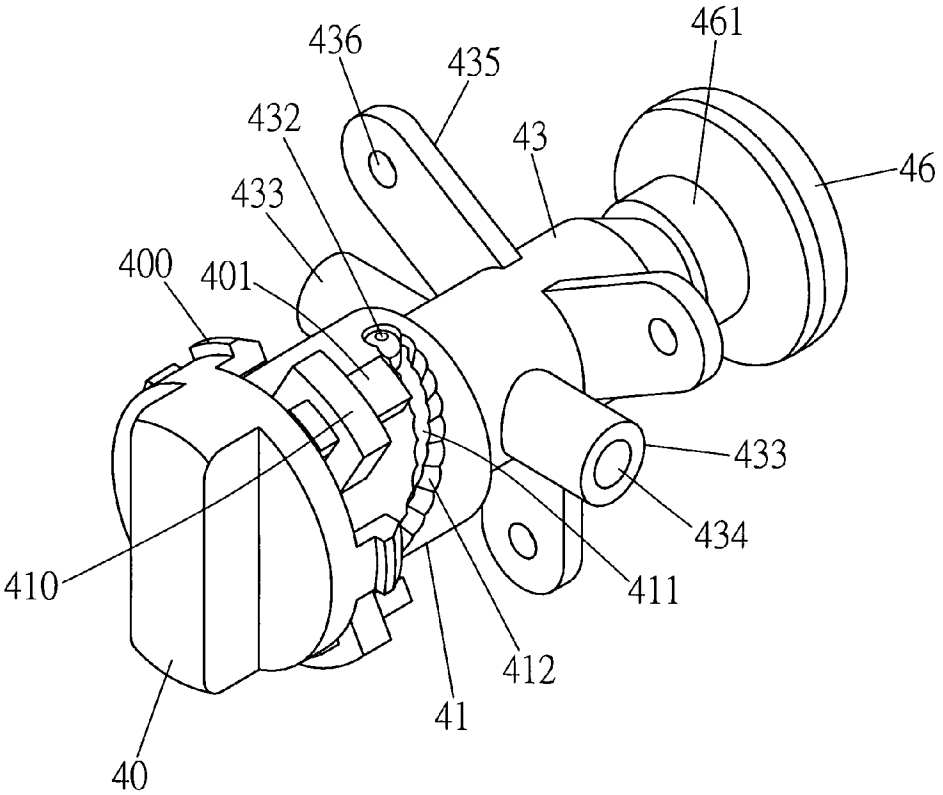
FIG. 6 is a perspective view of the relief valve of the snivel suction device of the present invention.

A relief valve 4 is installed at the casing 3 that has the suction hole 32 for cooperating with the suction pipes 14, 14'. The relief valve 4 has a knob 40, an adjustment member 41, a bolt 42, a valve body 43, a spring 44, a plug 45 and a sound member 46 as shown in FIGS. 4, 5 and 6. The knob 40, which can be rotatably mounted to the through hole 34, has multiple positioning members 400 and multiple bars 401. The adjustment member 41, which is located in the knob 40, has an outer tube and multiple guiding protrusions 410 at a bottom of the outer tube. The multiple bars 401 of the knob 40 are inserted through the guiding protrusions 410 of the adjustment member 41. The outer tube of the adjustment member 41 has two guide slots 411 defined spirally along its outer surface. Each of the guide slots 411 has multiple positioning recesses 412. The adjustment member 41 has an inner tube 413 extending from the bottom of the outer tube thereof, such that an annular recess 414 is defined between the inner tube 413 and the outer tube of the adjustment member 41. A passage 416 is defined in the inner tube 413. The inner tube 413 of the adjustment member 41 is provided with inner threads 417 at an inner surface thereof which defines the passage 416, near its bottom for threaded engagement with the bolt 42. Furthermore, the inner tube 413 of the adjustment member 41 is provided at its outer surface with a seal ring 415. The bolt 42 has a protrusion 420 at its front end for fitting with a rear end of the spring 44 and defines a slot 421 at its rear end. The valve body 43 has a main tube defining therein an inner space 431. One end of the main tube is provided with two positioning parts 432 and inserted into the annular recess 414 of the adjustment member 41 whilst another end of the main tube is formed into a reduced tubular portion 430, wherein the two positioning parts 432 are respectively located in the guide slots 411 of the adjustment member 41. The valve body 43 has two connection tubes 433, each of which defines therein a passage 434 communicating with the inner space 431 of the main tube of the valve body 43. The relief valve 4 has multiple fixing lugs 435 and each fixing lug 435 has a hole 436. The valve body 43 is fixed to the casing 3 by inserting fasteners 437 through the holes 436 of the fixing lugs 435 to engage with the casing 3. The plug 45 is fitted in the inner space 431 of the main tube of the valve body 32 and forced by the spring 44 to seal the inner space 431 at the reduced tubular portion 430. The plug 45 of the relief valve 4 has a curved face 450 formed at its front end, towards the reduced portion 430 of the main tube of the valve body 43, and a protrusion 451 at its rear end for fitting with a front end of the spring 44. The sound member 46 defines therein an inner space 460 and has a mounting tube 461 for allowing the sound member 46 to be mounted over the reduced tubular portion 430 of the main tube of the valve body 43. The sound member 46 defines an outlet hole 462 within the mounting tube 461, communicating with the inner space 460, and defines an inlet hole 463 opposite to the outlet hole 462, communicating with the inner space 460.

Figure 9:
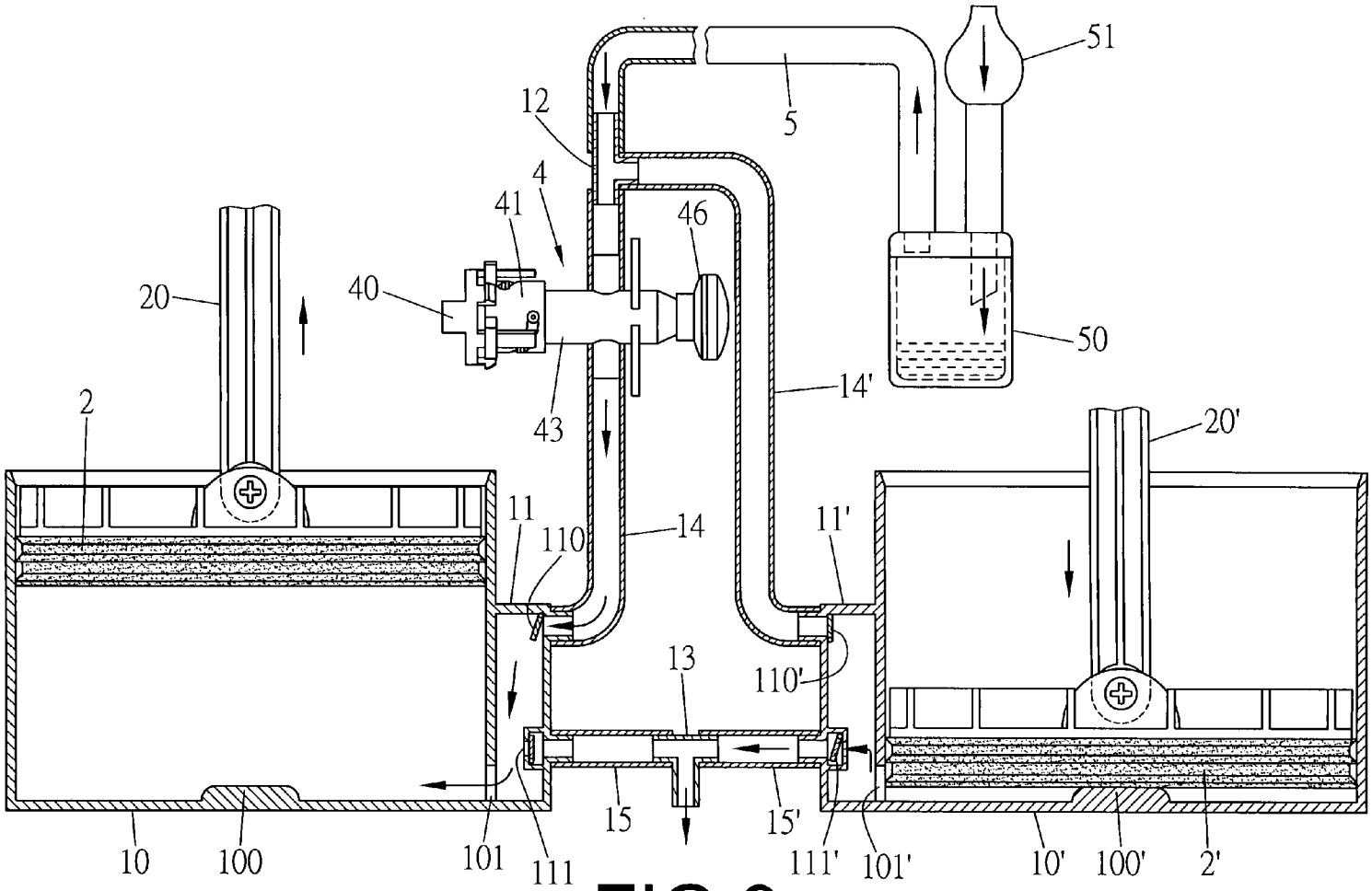
FIG. 9 shows a connection diagram of various components of the snivel suction device of the present invention.

As shown in FIG. 9, when in use, the user operates the two opposite parts of the pedal 21 alternately so that the pedal 21 is pivoted to operate the two connection rods 20, 20'. The two pistons 2, 2' are moved forth and back in the two pump cylinders 10, 10' and cooperated with the two suction check valves 110, 110' and the two release check valves 111, 111' to alternately suck and release the air. When sucking the air, the suction tee 12 sucks the air outside the casting 3 into the pump cylinders 10, 10', and when releasing the air, the air contained in the pump cylinders 10, 10' are expelled into the environment outside the casting 3' via the release tee 13. By this way, as the user continuously operates the pedal 21, the air is transferred continuously.

An outer suction pipe 5 is connected between the suction tee 12, which is exposed to the suction hole 32 of the casing 3, and a collection cup 50 as shown in FIG. 9. The collection cup 50 has a suction member 51 which is inserted into the nose of the user and the pedal 21 is then operated as mentioned above, so that the snivel is sucked via the suction member 51 and collected in the collection cup 50. When the suction member 51 is in contact with the nasal mucosa, since the suction member 51 is blocked, a vacuum pressure is occurring in the suction pipes 14, 14'. When the vacuum pressure in the suction pipes 14, 14' reaches a predetermined level, outside air can overcome the spring 44 of the relief valve 4 and push the plug 45 of the relief valve 4 inwardly, so that the reduced tubular portion 430 of the main tube of the valve body 43 is no longer sealed by the plug 45. Consequently, outside air can be sucked into the suction pipes 14, 14' via the inlet hole 463 of the sound member 46, the outlet hole 462 of the sound member 46, the main tube of the valve body 43, and the connection tubes 433 of the valve body 43 (see FIG. 8). Thereafter, the air can flow into the pump cylinder 10. When the air is sucked into the valve body 43 via the sound member 46, sound is generated to notify the user that the relief valve 4 has been actuated and this means that a higher vacuum pressure has occurred in the suction pipe 14. The user then has to check whether the suction member 51 is in contact with the nasal mucosa. If the user continuously sucks air when the suction member 51 is in contact with the nasal mucosa, by the relief valve 4, the user's nasal mucosa is not injured. When the block problem is cleared, namely that the suction member 51 is not in contact with the nasal mucosa, the spring 44 can push the plug 45 to urge against the inner surface of the reduced tubular portion 430 of main tube of the valve body 43. The suction tee 12 can start to suck air again.

Figure 7:
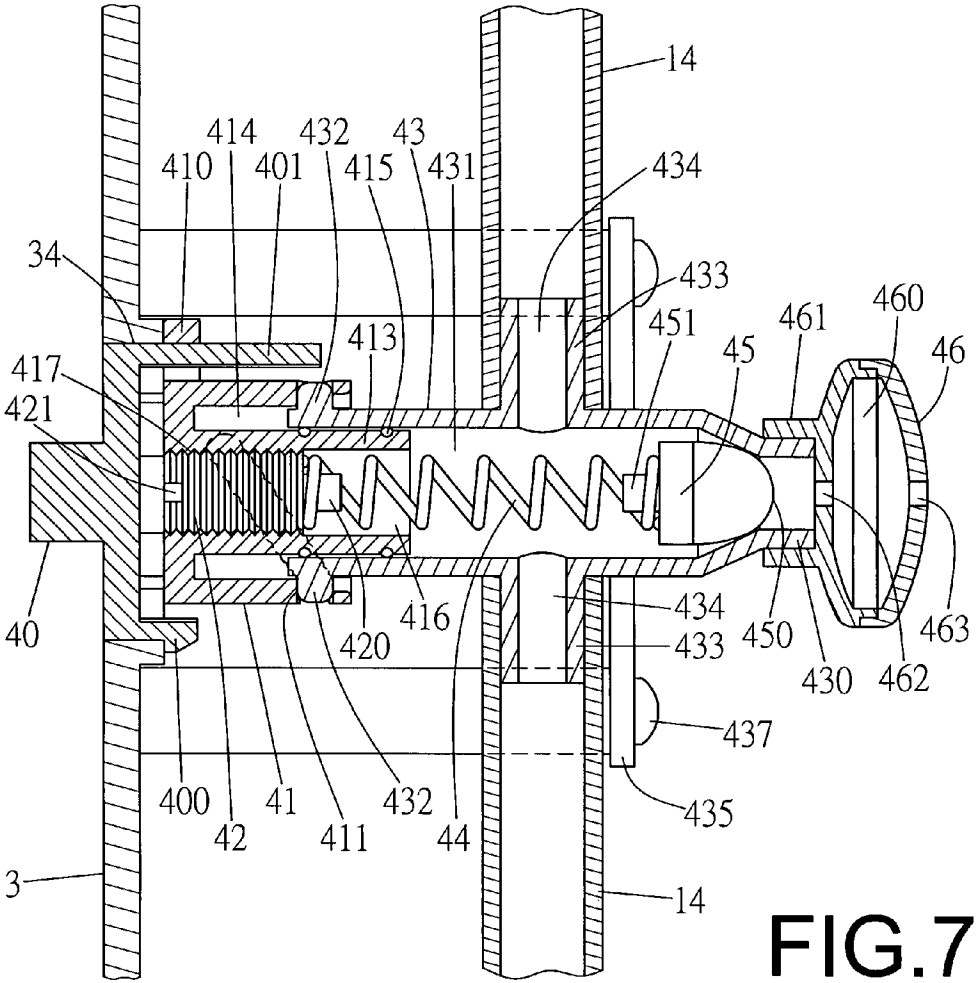
FIG. 7 is a cross sectional view of the relief valve of the snivel suction device of the present invention.
Figure 8:
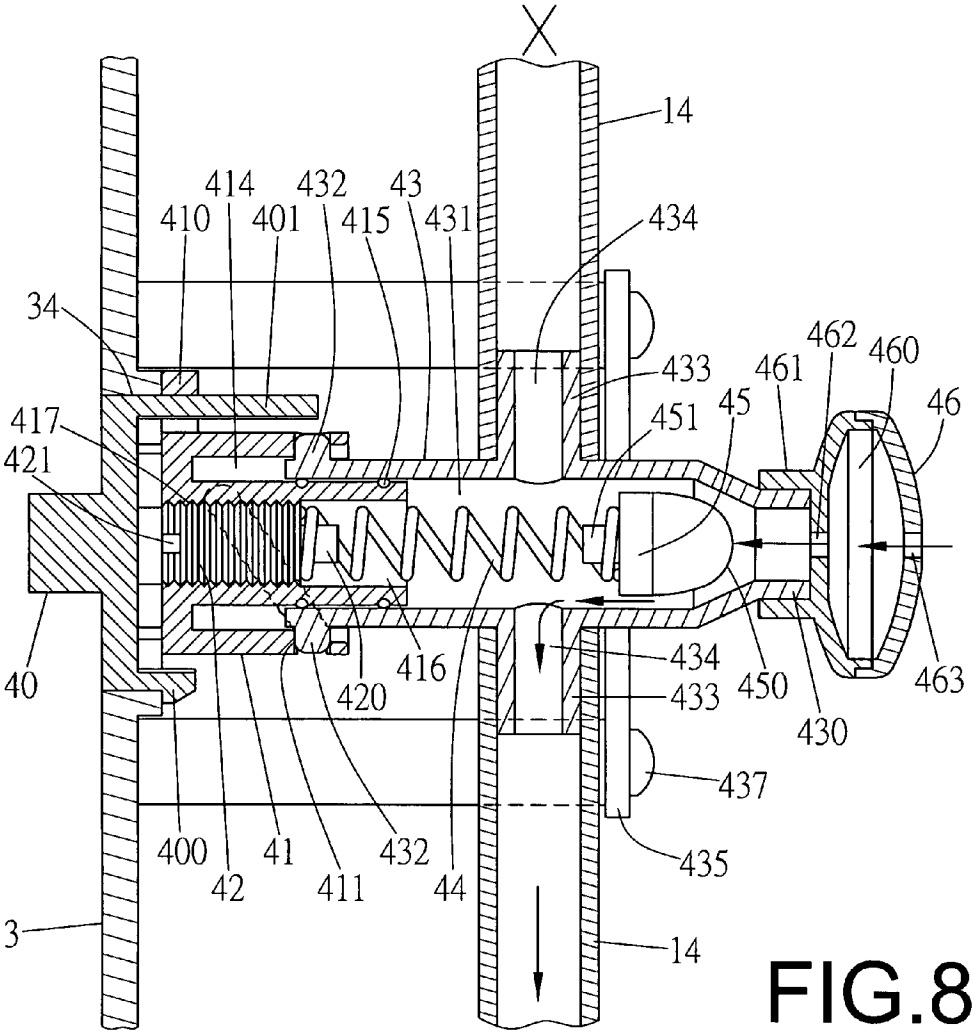
FIG. 8 shows that the relief valve is actuated to reduce the level of vacuum pressure when one end of the suction pipe is blocked.
Figure 10:
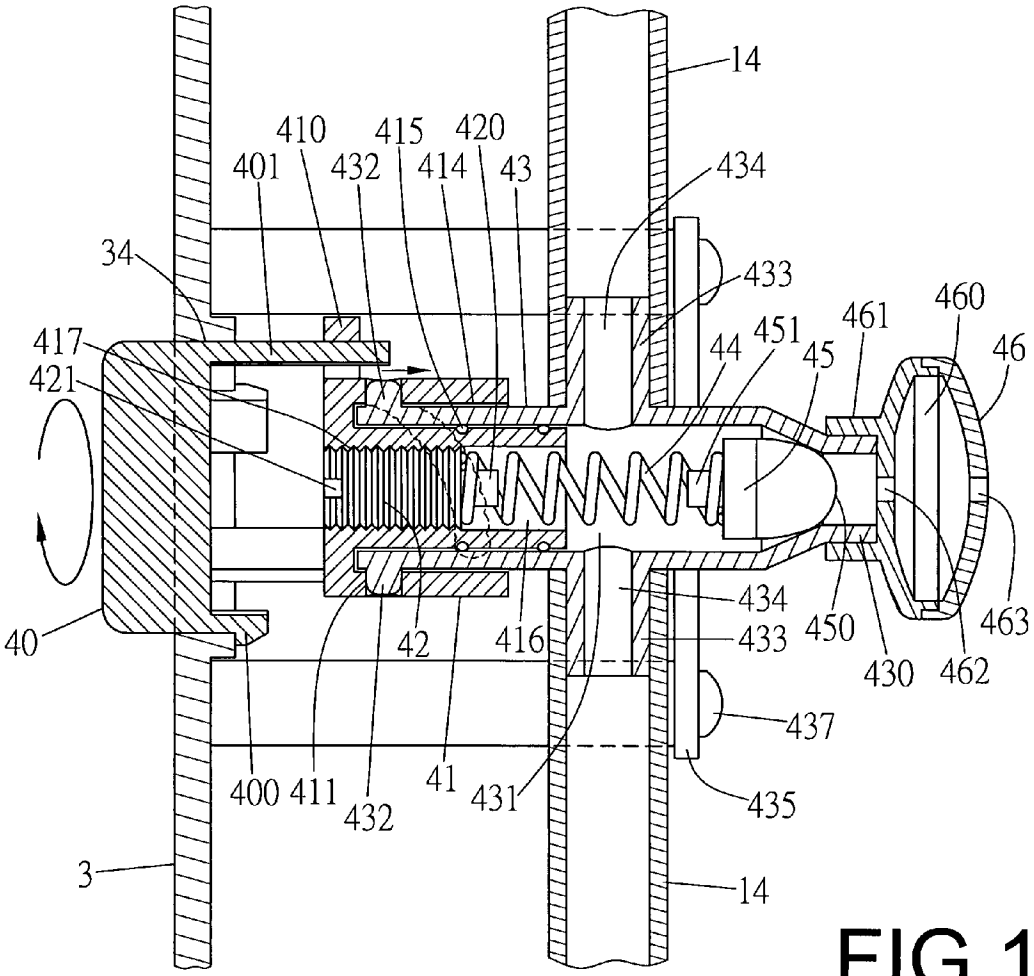
FIG. 10 shows the relief valve of the snivel suction device of the present invention being adjusted to increase the actuation pressure of the relief valve.

As shown in FIGS. 7 and 10, the actuation pressure of the relief valve 45 can be adjusted according to the practical needs. When the snivel suction device is used to an infant, the knob 40 is rotated to have the adjustment member 41 rotated, so that the positioning parts 432 of the valve body 43 can move along the guide slots 411 of the adjustment member 41, and thus the adjustment member 41 can be moved towards the knob 40. As such, the force of the spring 44 applying to the plug 45 is reduced. When the knob 40 is rotated to the desired position, at which a proper actuation pressure of the relief valve 4 has been achieved, the two positioning parts 432 are engaged with two of the positioning recesses 412 of the guide slots 411 of the adjustment member 41. The user then can start to suck the snivel. Referring to FIG. 10, when using the suction device to an adult, the knob 40 is rotated to have the adjustment member 41 moved toward the valve body 43. As such, the force of the spring 44 applying to the plug 45 can be increased. Therefore, a higher actuation pressure of the relief valve 4 can be achieved.

While we have shown and described the embodiment in accordance with the present invention, it should be clear to those skilled in the art that further embodiments may be made without departing from the scope of the present invention.

What is claimed is:

1. A snivel suction device comprising:

a base plate;

two pump cylinders mounted on the base plate, each pump cylinder having a protrusion at an inner surface of its bottom, each pump cylinder being provided at its surrounding wall with a manifold and defining a through hole which allows the manifold to communicate with an inner space of the corresponding pump cylinder, each manifold being provided with a suction check valve and a release check valve;

a suction tee and a release tee respectively provided on the base plate;

a first suction pipe connected between the suction tee and the suction check valve of the manifold of one of the two pump cylinders;

a second suction pipe connected between the suction tee and the suction check valve of the manifold of the other one of the two pump cylinders;

a first release pipe connected between the release tee and the release check valve of the manifold of one of the two pump cylinders;

a second release pipe connected between the release tee and the release check valve of the manifold of the other one of the two pump cylinders;

two pistons respectively located in the two pump cylinders;

two casings connected to the base plate and covering the two pump cylinders, each casing having a notch and a lug with a pivotal hole, one of the two casings defining a suction hole corresponding to one opening of the suction tee whilst the other one of the two casings defining a release hole corresponding to one opening of the release tee;

a pedal having a first part and a second part, the pedal being pivotally connected to the pivotal holes of the lugs of the two casings by two pivots;

a first connection rod connected between the first part of the pedal and one of the two pistons;

a second connection rod connected between the second part of the pedal and the other one of the two pistons, wherein the first and second connection rods respectively pass through two holes formed by the notches of the two casings, so that the two pistons can be driven by the pedal to conduct forth-and-back motion in the pump cylinders;

a relief valve installed at one of the two casings for cooperating with the first and second suction pipes, the relief valve having a knob, an adjustment member, a bolt, a valve body, a spring, a plug and a sound member, the knob having multiple positioning members and multiple bars, the adjustment member located in the knob and having an outer tube and multiple guiding protrusions provided at a bottom of the outer tube, the multiple bars of the knob being inserted through the guiding protrusions of the adjustment member, the adjustment member having an inner tube extending from the bottom of the outer tube thereof such that an annular recess is defined between the outer tube and the inner tube thereof, the outer tube of the adjustment member defining at least one guide slot at its outer surface, the guide slot having multiple positioning recesses, the inner tube of the adjustment member being provided with inner threads at its inner surface, near its bottom, for threaded engagement with the bolt, the inner tube of the adjustment member being provided at its outer surface with a seal ring, the valve body having a main tube, one end of which is provided with a positioning part and capable of being inserted into the annular recess of the adjustment member whilst another end of which is formed into a reduced tubular portion, the positioning part of the main tube of the valve body being located in the guide slot of the adjustment member, the valve body having two connection tubes which communicate with the main tube, the valve body being connected to one of the first and second suction pipes through the two connection tubes, the plug being fitted in the main tube of the valve body and urged by the spring located between the bolt and the plug, the sound member defining therein an inner space and having a mounting tube which allows the sound member to be mounted over the reduced tubular portion of the main tube of the valve body, the sound member defining an outlet hole within the mounting tube, which communicates with the inner space of the sound member, and defining an inlet hole opposite to the outlet hole, which communicates with the inner space of the sound member.

2. The snivel suction device as claimed in claim 1, wherein a pad is attached to an underside of the base plate.

3. The snivel suction device as claimed in claim 1, wherein the first and second parts of the pedal are symmetrical about a pivotal axis which is aligned with the two pivots, and each of the first and second parts of the pedal extends at an angle to a horizontal line.

4. The snivel suction device as claimed in claim 1, wherein the bolt of the relief valve has a protrusion at its front end for fitting with a rear end of the spring and defines a slot at its rear end.

5. The snivel suction device as claimed in claim 1, wherein the valve body of the relief valve has multiple fixing lugs for fixing the valve body to one of the casings.

6. The snivel suction device as claimed in claim 1, wherein the plug of the relief valve forms a curved face at its front end, towards the reduced tubular portion of the main tube of the valve body, and has a protrusion at its rear end for fitting with a front end of the spring.

* * * * *